United States Patent [19]

Spruyt

[11] 4,079,607

[45] Mar. 21, 1978

[54] KEY RING STRUCTURE

[75] Inventor: Harry Spruyt, New York, N.Y.

[73] Assignee: Cole National Corporation, Cleveland, Ohio

[21] Appl. No.: 755,252

[22] Filed: Dec. 29, 1976

[51] Int. Cl.[2] ..... A47G 29/10

[52] U.S. Cl. ..... 70/456 R; 70/459

[58] Field of Search ..... 70/459, 456 R, 456 B; 24/3 K, 238, 239; 150/40

[56] References Cited

U.S. PATENT DOCUMENTS 863,297 8/1907 Lynn ..... 70/459

FOREIGN PATENT DOCUMENTS 1,462,881 11/1966 France ..... 70/459

*Primary Examiner*—Robert L. Wolfe

*Attorney, Agent, or Firm*—Fay & Sharpe

[57] ABSTRACT

A ring member comprised of a generally flat body section and a ring section defining a substantially closed loop at one end thereof is closely slidably received within a hollow open ended slide member. Spring biasing means are received in an elongated slot in the ring member body section with one end of the spring operating against one end of the slot and the other end operating against a tab member which comprises a part of the slide member. The spring continuously urges the slide member to a first normal position blocking an opening in the substantially closed loop of the ring section and also allows selective movement between the ring and slide members so as to expose the loop opening. A decorative outer cover closely surrounds the slide member. The slide member and outer covering include cooperating means for retaining the cover in position on the slide.

16 Claims, 6 Drawing Figures

FIG. 1
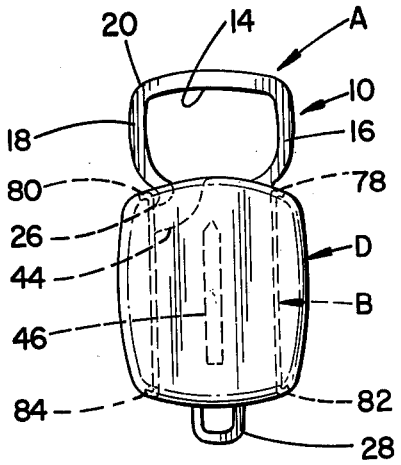
FIG. 3
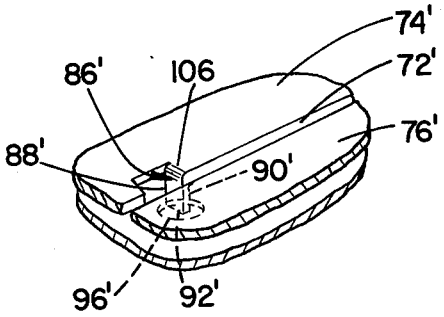
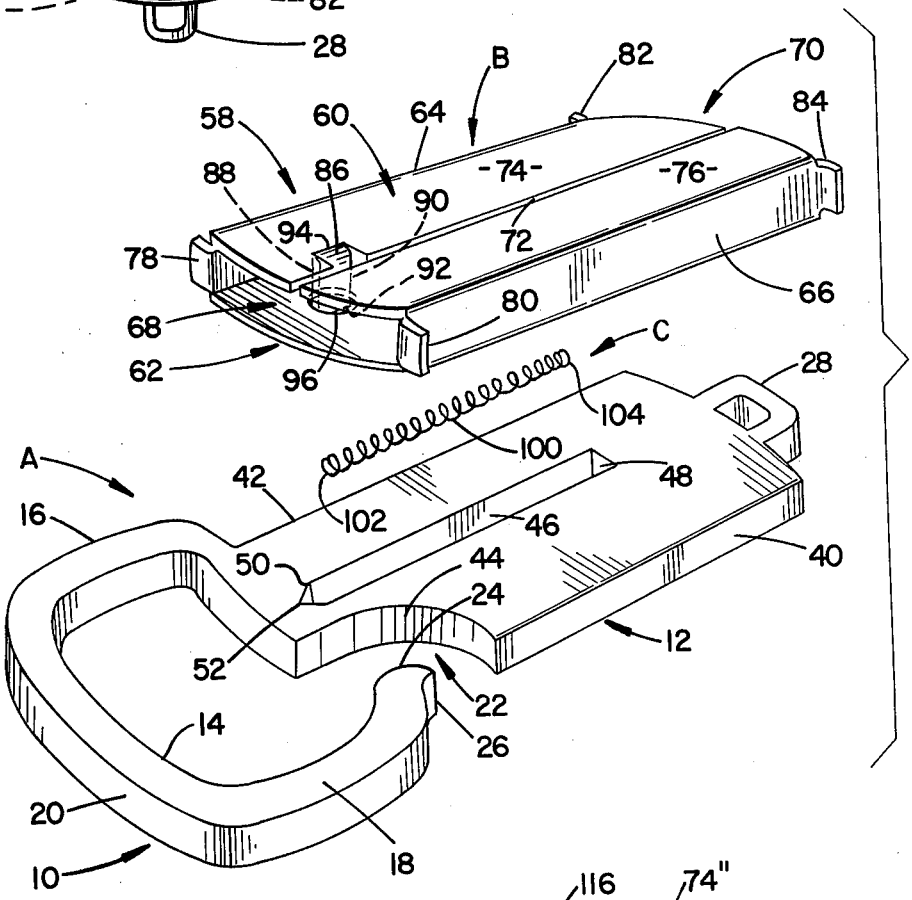
FIG. 2
FIG. 4
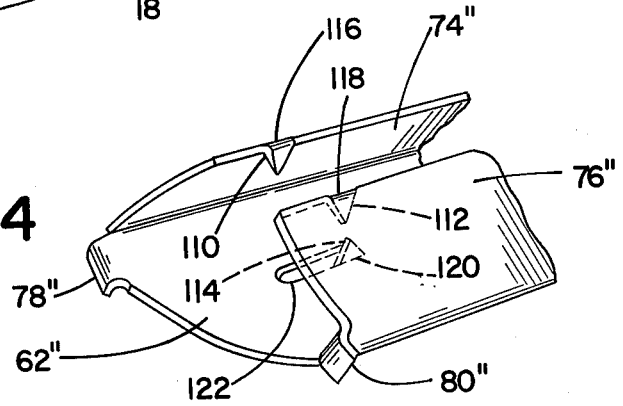

KEY RING STRUCTURE

BACKGROUND OF THE INVENTION

This invention pertains to the art of key rings and more particularly to key ring structures which may be selectively opened and closed to permit the addition and removal of keys therefrom.

The invention is particularly applicable to a key ring structure of the biased slide type and will be described with particular reference thereto; however, it will be appreciated by those skilled in the art that the invention has broader applications for use in other environments and for other purposes.

Key ring structures of the biased slide type having various specific designs are known in the art. In such structures, a ring member having a ring section is interconnected to a generally flat body section with the body section then closely slidably received in the hollow open ended slide member. Spring biasing means are disposed between the slide and ring members and operate in a manner such that the slide member is continuously urged to a position where it closes an access opening to the ring section to prevent removal of keys and the like received on the ring section. The slide and ring members are selectively movable relative to each other by overcoming the spring biasing force in order to expose the ring section access opening.

While many key ring structures of the biased slide type are known in the art, most of these structures are somewhat complicated in design and require a number of manufacturing steps and components which add undesired cost to the overall key ring structure. Moreover, such structures have not included decorative outer coverings for the slide members and have not, therefore, provided readily acceptable appearances from an aesthetic point of view.

Accordingly, it has been found desirable to develop a key ring structure generally of the biased slide type which is easy and simple to manufacture and which provides an acceptable aesthetic appearance. Moreover, it has also been desired to provide a key ring structure of this type which includes a permanently affixed decorative outer covering and which covering is readily adaptable to display a wide variety of advertising materials, initials and the like in a wide variety of forms.

The present invention contemplates a new and improved article which overcomes the above referred to problems and others, fulfills the above noted needs and provides a new key ring structure of the biased slide type which is simple to manufacture, provides a pleasing aesthetic appearance and which provides for the use of outer decorative coverings of many different styles and types.

BRIEF DESCRIPTION OF THE INVENTION

In accordance with the present invention, there is provided a new key ring structure of the biased slide type. This new structure includes a ring member having a ring section interconnected to a generally flat body section. The ring section defines a substantially closed loop including an opening or body sections. The body section includes an arcuate lead in area adjacent the opening or access and an elongated through slot extends generally longitudinally over a portion of the length of the body section. An open ended hollow slide member is closely slidably received over at least a portion of the ring member body section and is comprised of opposed top and bottom walls and opposed side walls. At least one of the top and bottom walls includes at least one protrusion extending inwardly therefrom toward the opposite wall in registry with the slot in the ring member. A biasing means is disposed in the elongated slot with one portion thereof acting against the end of the slot spaced remote from the ring section and another portion thereof acting against the protrusion. Through this cooperating arrangement, the key ring structure is continuously urged to a first position wherein the slide member is closely spaced on the body section toward the ring section in a manner so as to close the ring section opening or access area. The ring structure may be slidably moved against the biasing force of the biasing means to a second position with the slide member spaced along the body section apart from the ring section to expose at least the opening or access area.

According to another aspect of the present invention, the at least one protrusion included in the slide member is formed integrally with either the top or bottom wall and extends generally transverse of that wall toward the other wall.

In accordance with still another aspect of the present invention, the at least one protrusion comprises a tab member which is bent inwardly from one of the top and bottom walls along a line of bend disposed generally longitudinally of the slide member itself.

In accordance with a further aspect of the present invention, the slide member includes retainer protrusions extending outwardly from the slide member side walls at the opposite ends thereof. These retainer protrusions are adapted to retainingly engage a decorative cover which is closely received over the slide member.

In accordance with another aspect of the present invention, the decorative cover is comprised of first and second interfitting portions with the slide member received therebetween.

The principal object of the present invention is the provision of a new and improved key ring structure of the biased slide type.

Another object of the present invention is the provision of a key ring structure of the biased slide type which is simple in design.

Another object of the present invention is the provision of a key ring structure of the biased slide type which is easy and inexpensive to manufacture.

Still another object of the present invention is the provision of a key ring structure of the biased slide type which includes one of a variety of different decorative covers received over the slide member.

BRIEF DESCRIPTION OF THE DRAWINGS

The invention may take physical form in certain parts and arrangements of parts, preferred embodiments of which will be described in detail in the specification and illustrated in the accompanying drawings which form a part hereof and wherein:

FIG. 1 is a plan view of a key ring structure which incorporates the concepts of the subject invention;

FIG. 2 is an exploded perspective view of the ring member, slide member and biasing means which form a part of the present invention;

FIG. 3 is a partial perspective view showing an alternative arrangement for a portion of the slide member;

FIG. 4 is a partial perspective view with the slide member partially unfolded to show still another alternative arrangement therefor;

DESCRIPTION OF THE PREFERRED EMBODIMENT

Figure 5:
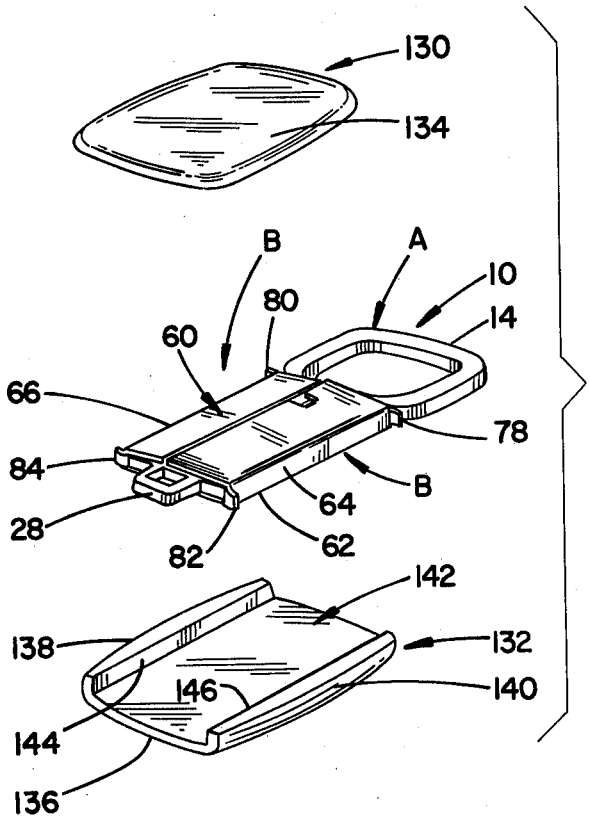
FIG. 5 is an exploded perspective view showing one arrangement for a decorative cover; and, FIG. 6 is an exploded perspective view showing an alternative arrangement for a decorative cover.

Referring now to the drawings wherein the showings are for purposes of illustrating preferred embodiments of the invention only and not for purposes of limiting same, the FIGURES show a key ring structure comprised of a ring member A, a slide member B, biasing means C and a decorative cover D.

More specifically, and with particular reference to FIGS. 1 and 2, ring member A is shown as being comprised of a ring section 10 and a body section 12. Ring section 10, in turn, is comprised of a substantially closed loop 14 having opposed side portions 16,18 and a top portion 20. An opening or access area generally designated 22 is disposed at the innermost end of side portion 18 adjacent body section 12. At the opening or access area, side portion 18 has an enlarged or rounded area 24 and a small lip-like area 26 extending longitudinally toward body section 12. Desirably disposed at the opposite end of the body section 12 from ring section 10 is a small closed loop area generally designated 28. In some key ring structures which utilize the concepts of the present invention, it may be desirable to eliminate closed loop 28 and modify the precise configuration of ring section 10 from that described above and shown in the drawings. Such modifications are not deemed to depart from the intent and scope of the present invention.

Body section 12 is substantially flat and has opposed side edges 40,42 extending longitudinally thereof. Disposed adjacent the interconnection between the ring and body sections and defining one side of opening 22 is a concave or arcuate lead in area 44. An elongated through slot 46 is generally centrally disposed in the body section to extend longitudinally over a substantial portion thereof. The end 48 of slot 46 which is spaced toward loop area 28 is disposed substantially transverse to the slot side walls and the other end 50 has a generally triangular configuration with the side walls thereof converging to a vertex 52. The reasons for the particular triangular configuration of end 50 will become apparent hereinafter.

In the embodiment of the invention here under discussion, ring member A could be constructed from any generally rigid plastic or metal. Preferably, however, the ring member comprises a sheet metal stamping which, for aesthetic purposes, may be chrome, copper or brass plated as desired.

Slide member B comprises a hollow rectangular sleeve generally designated 58. In the preferred embodiments described hereinafter, slide member B is formed from thin metal such as steel and the like, although other materials could also be advantageously employed without departing from the intent and scope of the invention. Sleeve 58 includes parallel spaced apart top and bottom walls 60,62, opposed spaced apart side walls 64,66 and opposed open ends 68,70. In the preferred arrangement here under discussion, sleeve 58 is formed from a single piece of sheet metal in a manner such that the opposite side edges of the sheet metal blank are formed so as to be closely spaced to each other in top wall 60 so as to define a seam or slot area generally designated 72. Thus, top wall 60 is actually comprised of two top wall halves or portions 74,76. It is also possible to construct the slide member by other means so as to eliminate the seam or slot area 72 entirely or to at least eliminate it from top wall 60.

Integrally formed and extending outwardly or laterally from side walls 64,66 at ends 68,70 are cover retainer protrusions 78,80,82 and 84. As best shown in FIGS. 1 and 2, these protrusions extend outwardly generally transverse to side walls 64,66 for engagement with the outer peripheral edge of a decorative cover for purposes of permanently retaining the cover in position on the slide member. This aspect of the present invention will be described in greater detail hereinafter. While retainer protrusions 78,80,82 and 84 are shown as extending transversely from side walls 64,66 prior to the time the decorative cover is actually installed on the slide member, one of the associated pairs of protrusions 78,80 or 82,84 may be disposed to extend generally coplanar with side walls 64,66 to facilitate ease and convenience for locating the cover on the slide member. Following such locating, this pair of tabs may then be bent to a position extending outwardly of the side walls into close engagement with the peripheral edge of the cover.

Disposed adjacent open end 68 of the slide member and extending inwardly from top wall portion 74 toward bottom wall 62 is a protrusion or tab 86. Tab 86 may be conveniently integrally formed with the sleeve member itself and, in the embodiment here under discussion, the tab includes opposed side edges 88,90 and a bottom edge 92. Actually, the tab may simply comprise a cut out area in top wall portion 74 which is bent inwardly along a line of bend 94 which extends generally longitudinal of the slide member. Disposed beneath protrusion or tab 86 in bottom wall 62 is an opening or slot 96 which is sufficiently large to receive at least bottom edge 92 and the outermost end of tab 86. This particular structural arrangement is for purposes of retaining a biasing means in an operable position between the ring and slide members as will be described hereinafter. It should be noted that the location of elongated slot 46 in body section 12 of ring member A and protrusion or tab 86 in body section 12 of ring member A and protrusion or tab 86 in slide member B are such that the tab will be placed in registry with and received through the slot when the slide member is properly received over the ring member.

Biasing means C, in the preferred embodiment, comprises an elongated coil spring 100 having opposed ends 102,104. This spring has a diameter smaller than the width of slot 46 in order that it may be freely received therein. Moreover, the length of the coil spring in its free state is substantially equal to the length of slot 46. Slide member B is dimensioned so that it may be closely slidably received over body section 12 of ring member A with the top, bottom and side walls of the slide member closely spaced to the corresponding top, bottom and side wall surfaces of body section 12. Spring 100 is received in slot 46 with end 102 engaging side edge 90 of tab 86 and end 104 engaging end wall 48 to thus urge relative movement between the slide and ring members with the slide member moved forwardly on the ring member body section 12 toward ring section 10. This position is the first or normal position for the key ring structure as shown in FIG. 1.

In this first position, enlarged or rounded area 24 and lip 26 of ring section 10 is received inside slide member B at open end 68 thereof thereby effectively closing opening or access area 22. It should also be noted that the longitudinal dimension of the slide member is substantially identical to the overall length of body section 12 so that ring section 10 is exposed from open end 68 and closed loop 28 is exposed from open end 70 in the first or normal position of the structure. Also, bottom edge 92 of tab 86 extends into opening or groove 96 to prevent escape of end 102 of spring 100 thereunder. When the ring and slide members are in their first or normal position, side edge 88 of tab 86 is guided by the sides of triangular end 50 into engagement with vertex area 52. This provides positive guiding and location for the slide member through tab 86 in order that enlarged rounded area 24 and lip 26 of substantially closed loop 14 may be properly received inside the slide member at open end 68. Moreover, the biasing force of spring 100 acts parallel to line of bend 94 of tab 86 so that there will be no tendency for the tab to unbend during normal use of the key ring structure over a long period of time.

Keys or the like are received on the closed loop in a conventional manner. When it is desired to add or remove keys from the loop, it is simply necessary to push against closed loop area 28 or pull against substantially closed loop 14 in a manner sufficient to overcome the biasing force of spring 100 so that ring member A is moved longitudinally outward from open end 68 of slide member B to a position exposing opening or access area 22 and at least a portion of arcuate or concave lead in area 44. Once the desired keys have been added to or removed from ring section 10, the slide and ring members will automatically again assume the first or normal position by action of spring 100 when the human biasing force is released.

Referring to FIG. 3, a slightly modified arrangement is shown for the protrusion or tab included as an integral part of the slide member. For purposes of convenience in appreciating and understanding this modification, like components are identified by like numerals including a primed (') suffix and new components are identified by new numerals.

In FIG. 3, tab 86' has a pair of spaced apart side edges 88',90' and a bottom edge 92'. As in the structure shown in FIGS. 1 and 2, tab 86' is formed or cut from a portion of top wall portion 74' of the slide member. Here, however, line of bend 106 is generally transverse to the longitudinal axis of the slide member itself. As a result, biasing forces exerted against the key ring structure either by the coil spring or by humans will have a tendency to unbend the tab about line of bend 106. Although this could be a problem in some circumstances, the fact that at least the bottom edge 92' is received in opening or slot 96' in the slide member bottom wall 62' holds any such unbending problems to a minimum.

FIG. 4 shows still another modification for the slide member tabs or protrusions. Here, like components are identified by like numerals with the inclusion of a double primed (") suffix and new components are identified by new numerals.

In FIG. 4, three integrally formed tab members generally designated 110,112 and 114 are included. The slide member of FIG. 4 has been partially opened for ease of illustration and it will be noted that tab 110 extends from top wall portion 74" toward bottom wall 62" along a line of bend 116; that tab 112 extends from top wall portion 76" toward bottom wall 62" along a line of bend 118; and, that tab 114 extends from bottom wall 62" toward top wall portion 74",76" along a line of bend 120. Also, bottom wall 62" includes an opening or slot 122 therein in order that the outermost ends of tabs 110,112 may be received therein for reasons described hereinabove with reference to the embodiment shown in FIGS. 1 and 2. It should also be noted here that the lines of bend 116,118 and 120 are generally parallel to the longitudinal axis of the slide member so that there will be no tendency for unbending of the tabs during normal and long term utilization of the key ring structure.

FIGS. 1 and 5 show the decorative outer cover D which is closely received on slide member B. FIG. 1 shows this cover once it has been installed on the slide member and FIG. 5 shows an exploded view whereby the details thereof may be fully appreciated. In the preferred embodiment, decorative cover D is comprised of interfitting upper and lower halves 130,132 with the upper half being closely received against upper wall 60 of slide member and at least a portion of the lower half being closely received against bottom wall 62 of the slide member. Upper half 130 includes an outer wall or surface 134 and lower half 132 includes an outer wall or surface area 136. The lower half includes opposed peripheral walls 138,140 which may be of any overall configuration desired to present a particular appearance. In the embodiment here under discussion, however, and as shown in FIGS. 1 and 5, peripheral walls 138,140 have a generally curvilinear configuration. Extending longitudinally through lower half 132 is a channel 142 which is dimensioned to closely receive slide member B. This channel includes opposed channel side walls 144,146 which have a heighth substantially commensurate with the height of slide member side walls 64,66. The ring and slide members A and B as shown in FIG. 5 may be placed into channel 142 of lower half 132 and upper half 134 then affixed to the lower half by any convenient means compatible with the cover material itself.

The length dimension of cover D is such that retainer protrusions 78,80,82 and 84 will be closely received against peripheral walls 138,140 of the cover immediately adjacent the ends of channel 142 side walls 144,146 as is plainly and best shown in FIG. 1 in order to prevent any longitudinal shifting of cover D on slide member B. As noted hereinabove, it may be desirable during forming of the slide member to allow one pair of retainer protrusions 78,80 or 82,84 to extend generally coplanar with the associated slide member side walls 64,66. In this manner, cover D may be assembled first and then slide onto slide member B with this one pair of retainer protrusions 78,80 or 82,84 then bent to an outward cover engaging position as shown in FIG. 1. This, of course, depends upon the specific construction for cover D and the manner in which it is desired to assemble the overall key ring structure.

In the cover shown in FIGS. 1 and 5, it is contemplated that upper and lower decorative cover halves 130,132 will be constructed from wood. With this type of cover material, it is possible to burn or otherwise affix indicia such as initials, logos, designs and the like to the outer walls or surfaces 134,136 thereof. Likewise, other materials could also be advantageously employed in constructing the cover without departing from the intent or scope of the present invention.

Figure 6:
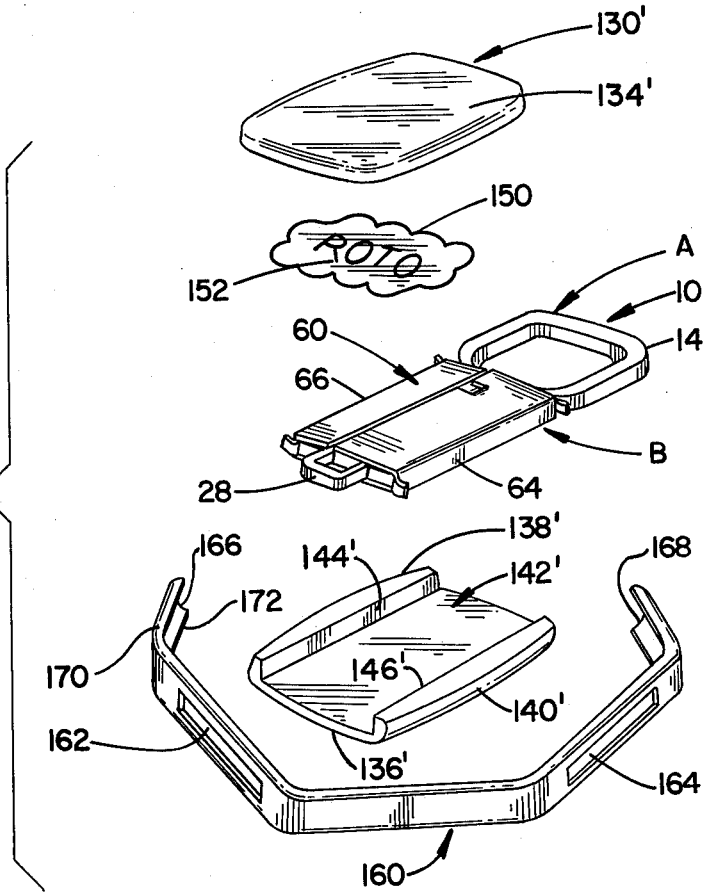

FIG. 6 shows still a slightly modified arrangement for cover D which has a generally rectangular peripheral configuration. For ease of illustration and appreciation of the invention, like components will be identified by like numerals with a primed (') suffix and new components will be identified by new numerals. In the FIG. 6 arrangement, at least outer surface 134' of cover upper half 130 is constructed from a transparent or translucent plastic material. This translucent or transparent area provides a window-like accommodation for an intermediate panel 150 received between top wall 60 of slide member B and the inner surface of upper cover half 130'. Intermediate layer or portion 150 may comprise paper, plastic or the like and may conveniently include indicia 152 thereon for advertising or identification purposes.

Moreover, this modified cover includes a continuous side molding or frame 160 closely received around the outer peripheral edge of the cover once the cover components have been assembled over and around the ring and slide members. A pair of elongated slots 162,164 are included in this side molding which register with ends 68,70 of the slide member to facilitate the passing of the substantially closed loop 14 and closed loop 28 therethrough. With this side molding or frame 160 construction, top and bottom edges 170,172 are bent slightly inward in a manner such that when ends 166,168 are joined together, edges 170,172 will closely embrace at least a portion of the outer peripheral edges of surface areas 134',136' adjacent peripheral walls 138',140' in order to retain the decorative cover components in position without the need for additional adhesive materials or connecting means.

While side molding 160 has been shown in FIG. 6 as strip having opposed ends 166,168 which must be joined together in order to complete the structure, it would also be possible to manufacture the side molding as a continuous loop. If this continuous loop structure is employed, top and bottom edges 170,172 are initially straight or coplanar with the remainder of side molding 160. After the cover components have been located on slide member B with the side molding surrounding the cover, top and bottom edges 170,172 may be crimped or bent into close engagement with at least a portion of the outer peripheral walls 138',140'. This type of alternate construction would permit the decorative cover components to be assembled and held in position without the necessary for additional adhesive materials or connecting means.

The preferred decorative cover structure disclosed in FIG. 6 contemplates that at least the upper and lower cover halves will be molded or formed from a plastic material. Also, intermediate layer 150 is preferably vacuum formed plastic and may be metalized or include defraction grating to provide a particular appearance. It would also be possible to mold upper half 130' and intermediate layer 150 in one piece with outer surface 134' comprising a lens and intermediate layer 150 comprising a three dimensional logo or other indicia. Side molding 160 may also be constructed from any of several materials including plastic and metals which may be treated as desired to give a particular appearance. The materials and methods of construction employed for any specific decorative cover will vary with the result and aesthetic appearance desired. Many other specific decorative cover designs and constructions could also be employed without departing from the intent and scope of the present invention.

The invention has been described with reference to the preferred embodiments. Obviously, modifications and alterations will occur to others upon the reading and understanding of this specification. It is my intention to include all such modifications and alterations insofar as they come within the scope of the appended claims or the equivalents thereof.

Having thus described my invention, I now claim:

1. A key ring structure comprising in combination:

a ring member having a ring section interconnected to a generally flat body section, said ring section defining a substantially closed loop having an opening adjacent the interconnection between said ring and body sections, said body section including an arcuate lead in area adjacent said opening and an elongated slot extending longitudinally over a portion of the length thereof;

an open ended hollow sheet metal slide member closely slidably received over at least a portion of said ring member body portion, said slide member having opposed top and bottom walls and opposed side walls with one of said top and bottom walls including at least one integrally formed tab extending inwardly thereof in registry with said slot in said ring member body section toward the other of said top and bottom walls and the other of said top and bottom walls including an opening therein adapted to receive at least the outermost end of said tab, said tab being bent inwardly from said one wall generally transverse of said top and bottom walls; and, biasing means received in said elongated slot with one end thereof acting against the end of said slot spaced remote from said ring section and the other end thereof acting against said at least one tab, whereby said key ring structure is continuously urged to a first position with said slide member closely spaced on said body section opening with said ring and slide members being slidably movable relative to each other against the biasing force of said biasing member to a second position with said body section to expose said opening and at least a portion of said lead in area.

2. The key ring structure as defined in claim 1 wherein said tab is bent inwardly along a line of bend disposed generally longitudinally of said slide member.

3. The key ring structure as defined in claim 2 wherein said slide member is formed from a single piece of sheet metal with the opposite edges of said piece being closely spaced to each other longitudinally along said one wall, said tab being bent inwardly toward the other of said walls from adjacent one of said end edges.

4. The key ring structure as defined in claim 3 including a pair of said tabs, said tabs oppositely disposed relative to each other with one of said tabs being disposed adjacent each of said end edges.

5. The key ring structure as defined in claim 1 wherein said at least one tab is bent inwardly along a line of bend disposed generally transverse of said slide member.

6. The key ring structure as defined in claim 1 wherein said slide member further includes retainer protrusions extending outwardly of said slide member side walls at the opposite ends thereof, said retainer protrusions adapted to engage a cover closely received over said slide member for retaining said cover thereon.

7. The key ring structure as defined in claim 6 wherein said retainer protrusions are integrally formed with said slide member and extend outwardly generally lateral of said side walls.

8. The key ring structure as defined in claim 1 further including a cover closely received over said slide member.

9. The key ring structure as defined in claim 8 wherein said cover is comprised of first and second portions with said slide member closely received therebetween.

10. The key ring structure as defined in claim 9 wherein at least one of said first and second portions includes a slide member receiving channel therein.

11. The key ring structure as defined in claim 8 further including a side molding member closely surrounding at least the outer peripheral edge of said cover.

12. The key ring structure as defined in claim 8 wherein one of said slide member and cover includes retainer protrusions for cooperative engagement with the other of said slide member and cover to maintain said cover in position on said slide member.

13. The key ring structure as defined in claim 12 wherein said retainer protrusions are included in said slide member and extend outwardly of said slide member side walls at each end thereof.

14. The key ring structure as defined in claim 1 wherein said ring member further includes a closed loop structure at the opposite end of said body section from said ring section.

15. The key ring structure as defined in claim 1 wherein said substantially closed loop defined by said ring section includes a terminal end portion at said opening, said terminal end portion including a lip protruding outwardly therefrom toward said body section with at least said lip being received in said slide member when said key ring structure is in the first position.

16. The key ring structure as defined in claim 15 wherein said elongated slot has opposed end walls, the end wall of said slot disposed adjacent said ring section being defined by a pair of wall portions converging to a vertex and defining a generally triangular end wall configuration, said wall portions guiding said protrusion to said vertex when said key ring structure is in said first position to thereby achieve proper alignment between said ring section and slide member with at least said terminal end portion lip received in said slide member closely adjacent an associated side wall thereof.

* * * * *